US006761126B2

(12) United States Patent
DiMaio et al.

(10) Patent No.: US 6,761,126 B2
(45) Date of Patent: Jul. 13, 2004

(54) APPARATUS FOR APPLICATION OF POLYMER RESIN ONTO THREADED FASTENERS

(75) Inventors: Anthony DiMaio, Haverhill, MA (US); Mahmoud Arslanouk, Haledon, NJ (US)

(73) Assignee: Nylok Corporation, Macomb, MI (US)

( * ) Notice: Subject to any disclaimer, the term of this patent is extended or adjusted under 35 U.S.C. 154(b) by 40 days.

(21) Appl. No.: 09/861,945

(22) Filed: May 21, 2001

(65) Prior Publication Data

US 2002/0170494 A1 Nov. 21, 2002

(51) Int. Cl.[7] ..... B05B 13/06

(52) U.S. Cl. ..... 118/306; 118/318; 118/322; 427/236

(58) Field of Search ..... 427/236; 118/305, 118/306, 317, 322, 313–319

(56) References Cited

U.S. PATENT DOCUMENTS 4,060,868 A * 12/1977 Axvig et al. ..... 118/308
4,366,190 A * 12/1982 Rodden et al. ..... 118/308
5,160,570 A * 11/1992 Dickey ..... 118/231
5,650,037 A * 7/1997 Larson ..... 411/258
6,156,392 A * 12/2000 Duffy et al. ..... 427/475

* cited by examiner

*Primary Examiner*—Richard Crispino
*Assistant Examiner*—Michelle A. Lazor
(74) *Attorney, Agent, or Firm*—Niro, Scavone, Haller & Niro

(57) ABSTRACT

An apparatus is disclosed for the application of a polymer resin to a threaded fastener, where the fastener includes a cylindrical body and the threads of the fastener are formed in a bore extending diametrically across the body. The apparatus generally comprises a conveyor, a resin application station and a fastener orientation station. The conveyor carries the fasteners along a predetermined path of travel, and includes one or more fastener support members that permit the individual fasteners to rotate about the axes of their cylindrical bodies. The application station comprises a nozzle which directs a stream of the resin toward the travel path of the fasteners. The orientation station includes a guide member which operates to rotate each of the fasteners relative to the conveyor as they move toward the application station, and to thereby properly orient the fasteners so the threaded bore of each fastener will intersect the resin stream as the conveyor carries the fasteners along the travel path and through the spray station.

12 Claims, 6 Drawing Sheets

APPARATUS FOR APPLICATION OF POLYMER RESIN ONTO THREADED FASTENERS

FIELD OF THE INVENTION

The present invention relates to an apparatus for applying polymer resin materials to threaded fasteners, and more particularly, to an apparatus for mechanically handling and orienting a small threaded fastener to properly position it for application of the resin to an internally threaded bore located in a cylindrical body of the fastener.

BACKGROUND OF THE INVENTION

It is common practice today in the fastener industry to apply various polymer resins to threaded fasteners. Among the most common practices is the application of a resilient polymer, typically nylon, to the fastener's threads to provide a self-locking function. Such fasteners, when assembled with another complementary threaded element, are resistant to loosening due to vibration or other external forces. In order to economically produce these self-locking fasteners, it is essential that the application of the polymer resin be accomplished by means of automated equipment, with production rates oftentimes in the range of thousands of pieces per hour. Such automated apparatus and processes, in turn, typically require some form of mechanical handling and part orientation equipment to ensure the proper placement of the resin to the desired threads of the fastener.

When the fastener involved is relatively small and comprises an internally threaded element, the problem of proper part orientation can be more difficult. In the case where the part is asymmetrical, this problem can be further exacerbated.

The present invention represents an efficient and cost effective solution to the problem of properly positioning a small threaded fastener having a cylindrical body with internal threads extending along a bore in the body, where the bore extends diametrically across the body along an axis generally perpendicular to the axis of the body.

SUMMARY OF THE INVENTION

The present invention is directed to an apparatus for the application of a polymer resin to a threaded fastener, where the fastener includes a cylindrical body and the threads of the fastener are formed in a bore extending diametrically across the body. The apparatus generally comprises a conveyor, a resin application station and a fastener orientation station. The conveyor carries the fasteners along a predetermined path of travel, and includes one or more fastener support members that permit the individual fasteners to rotate about the axes of their cylindrical bodies. The application station comprises a nozzle which directs a stream of the resin toward the travel path of the fasteners. The orientation station includes a guide member which operates to rotate each of the fasteners relative to the conveyor as they move toward the application station, and to thereby properly orient the fasteners so the threaded bore of each fastener will intersect the resin stream as the conveyor carries the fasteners along the travel path and through the spray station.

In one preferred embodiment, the guide member of the orientation station comprises a resilient guide surface which is biased toward the travel path of the fasteners and is shaped to complement the configuration of the travel path. In this way, as each of the fasteners carried by the conveyor enters the orientation station, the circumference of its cylindrical body engages the guide surface causing the fastener to rotate. However, the bore which extends through the cylindrical body forms an interruption in the circumference of the body. As a result, the fastener will rotate as it passes along the surface of the guide member, but will stop rotating and remain rotationally stationary when the interruption on the fastener's circumference is juxtaposed with the guide surface. In this way, each fastener exiting the orientation station is properly positioned for receipt of the resin stream as it subsequently enters the application station.

BRIEF DESCRIPTION OF THE DRAWINGS

These and other features, objects and advantages of the present invention will become apparent from the following description and drawings wherein like reference numerals represent like elements in several views, and in which.

DESCRIPTION OF THE PREFERRED EMBODIMENTS

Set forth below is a description of what are currently believed to be the preferred embodiments or best examples of the invention claimed. Future and present alternatives and modifications to the preferred embodiments are contemplated. Any alternates or modifications in which insubstantial changes in function, in purpose, in structure or in result are intended to be covered by the claims of this patent.

Figure 1:
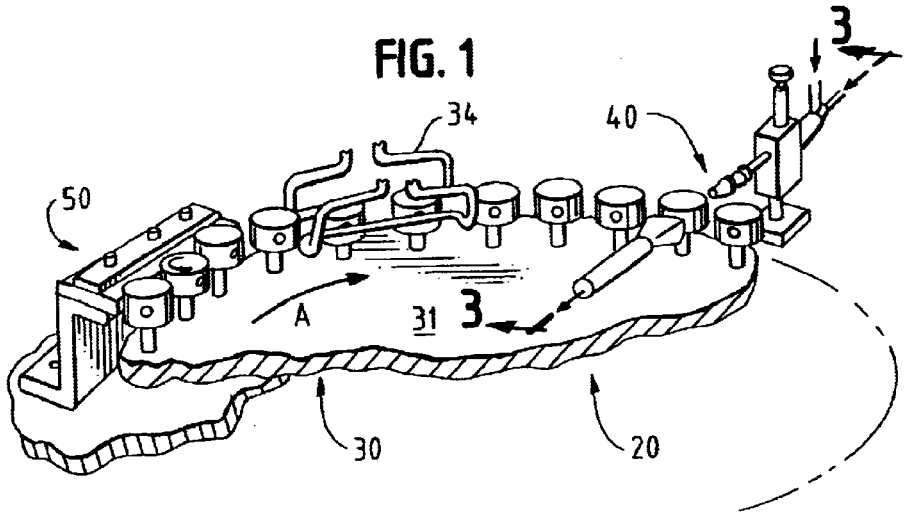
FIGS. 1 and 2 are, respectively, perspective and plan views of one preferred embodiment of the present invention.
Figure 2:
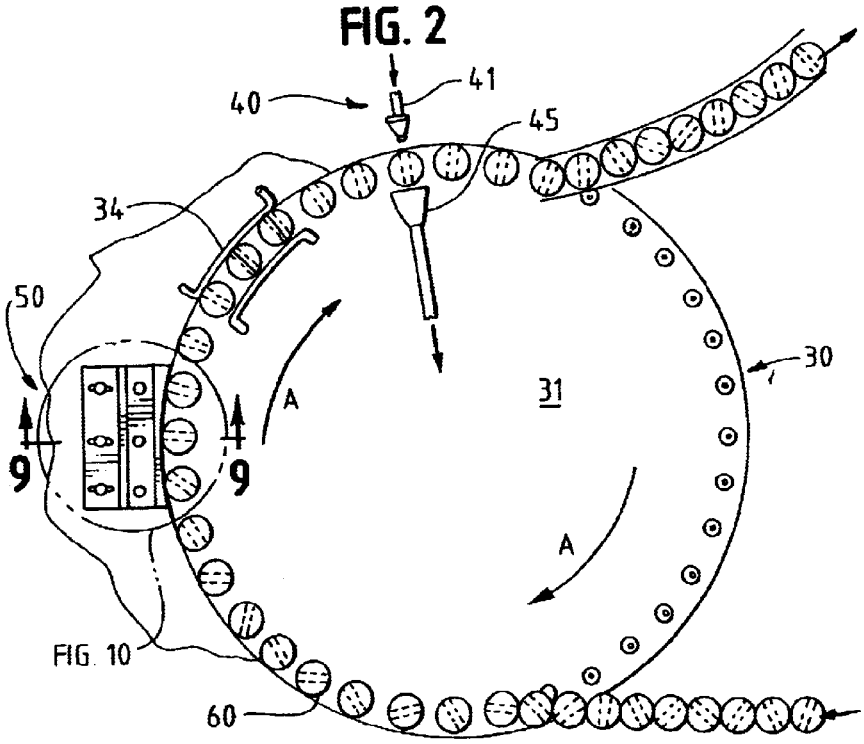
Figure 3:
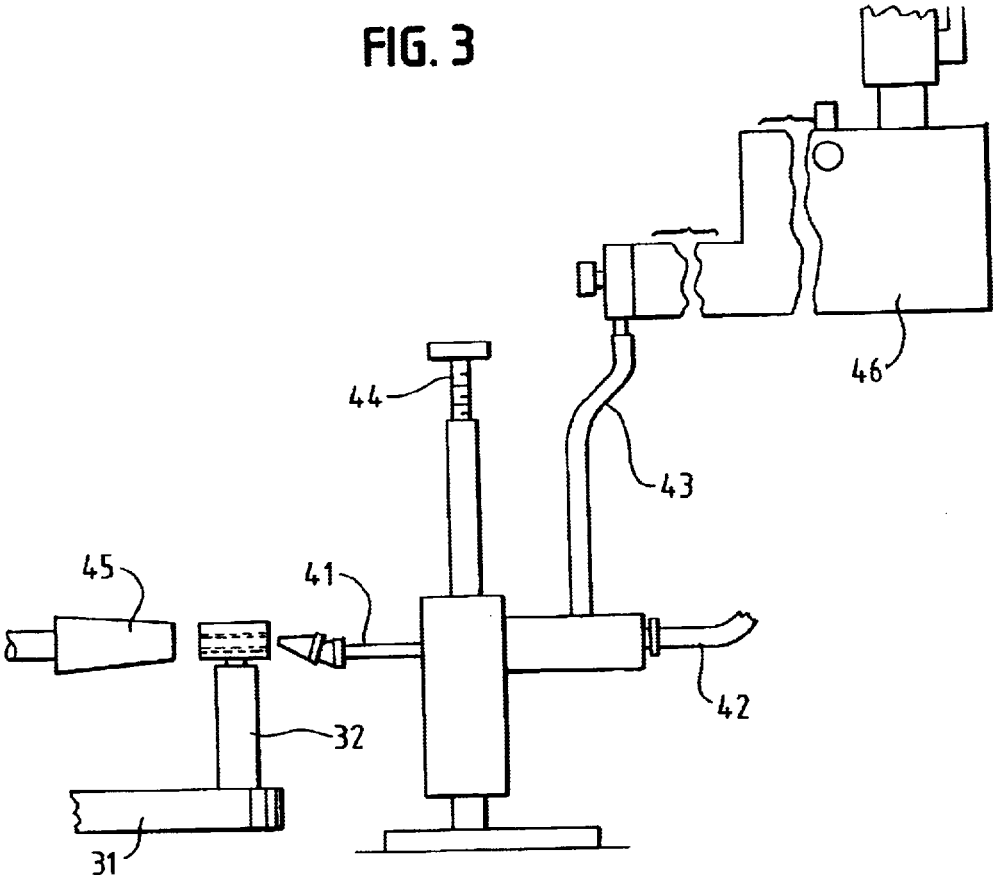
FIG. 3 is a schematic view taken along line 3—3 of FIG. 1 and showing various components of the preferred embodiment and their structural relationship.
Figure 4:
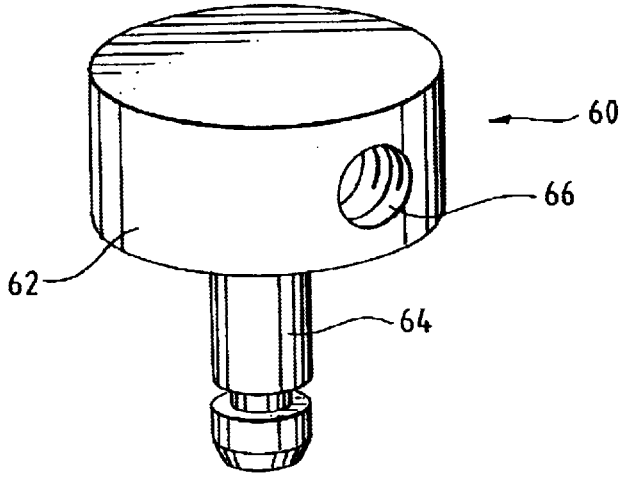
FIGS. 4–7 are various views illustrating a threaded fastener ideally suited for use in the embodiment shown in FIG. 1.
Figure 5:
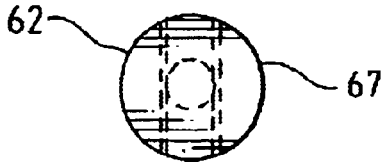
Figure 6:
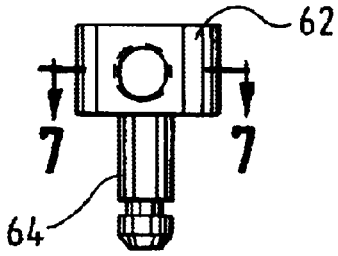
Figure 7:
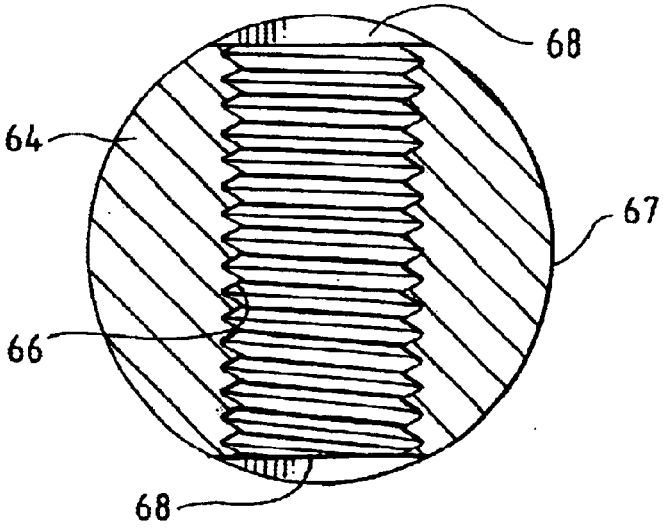

With particular reference to FIGS. 1, 2 and 3, an apparatus for applying polymer resin onto a threaded fastener is generally referenced as 20. Apparatus 20 comprises a conveyor 30, a resin application station 40 and an orientation station 50.

The present invention is intended for use with threaded fasteners in the form of a cylindrical body and having a threaded bore through the body. FIGS. 4–7 illustrate one such fastener 60. The fastener has a cylindrical body 62 and a shaft or shank 64. A threaded bore 66 extends diametrically through the body 62 such that the circumference 67 of the body 62 includes interruptions 68 defined by each end of the bore.

The conveyor 30 is shown here as a horizontal pin wheel, having a circular table 31 with support members or pins 32 positioned about the circumference of the wheel. Each pin 32 supports an individual fastener 60, carrying the fastener along a circular path of travel toward the application station 40. The travel path is most preferably circular, but it may also be arcuate or even linear. A variety of conveyors may be employed as illustrated in U.S. Pat. Nos. 3,579,684; 3,894,509; 3,995,074; 4,060,868; 4,775,555; 4,842,890; 4,865,881; 5,078,083; 5,571,323; 5,718,945; and 6,156,392. The disclosures are incorporated herein by reference.

Figure 8:
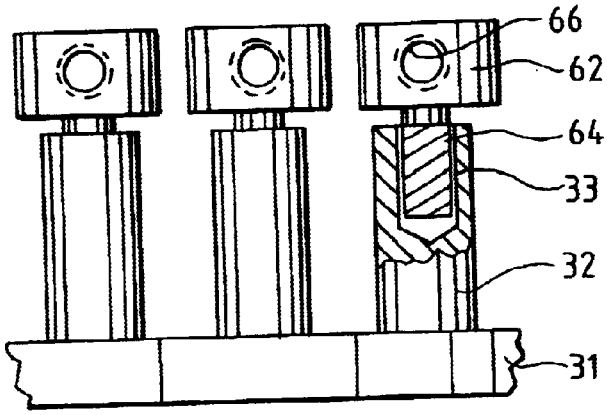
FIG. 8 is a side view showing the fastener illustrated in FIG. 4 mounted on the conveyor illustrated in FIG. 1.

Each of the support members 32 has a centrally disposed bore 33 (see FIG. 8) for receipt of shaft 64 of fastener 60. As a result, each fastener may freely rotate about its longitudinal axis when mounted onto support member 32.

As the fasteners move along their path of travel, indicated by the arrows A, they encounter the orientation station 50, which will be described below, and then move through an induction heater 34 and into application station 40.

Application station 40 includes a powdered resin spray nozzle 41 having both a pressurized gas source 42 and powdered resin supply 43. The spray nozzle directs an air-entrained stream of powdered resin particles toward the path of travel of the preheated fasteners. As the resin impinges the hot surface of the fasteners, it melts and coalesces into a generally homogeneous mass. Any overspray is collected by the vacuum nozzle 45, and recirculated to the resin supply reservoir 46. The position of spray nozzle 41 may be both horizontally and vertically adjusted by conventional mechanisms, such as thumbscrew adjuster 44. In one preferred form of the invention, a sensor may be used to detect the passage of individual fasteners through the application station, and the spray nozzle 41 may be operated in response to a signal from the sensor to discharge a pulse stream of resin onto each passing fastener. Details of these components are described in the above-identified U.S. Patents.

The orientation station 50 is positioned adjacent the conveyor 30 and includes a guide member 51 which engages each of the fasteners 60 to rotate the fastener about the axis of its cylindrical body. In this manner, the fasteners exiting the orientation station are positioned so that the threaded bore 66 of each fastener will intersect the resin stream emanating from spray nozzle 41 as the fasteners pass through application station 40.

Figure 9:
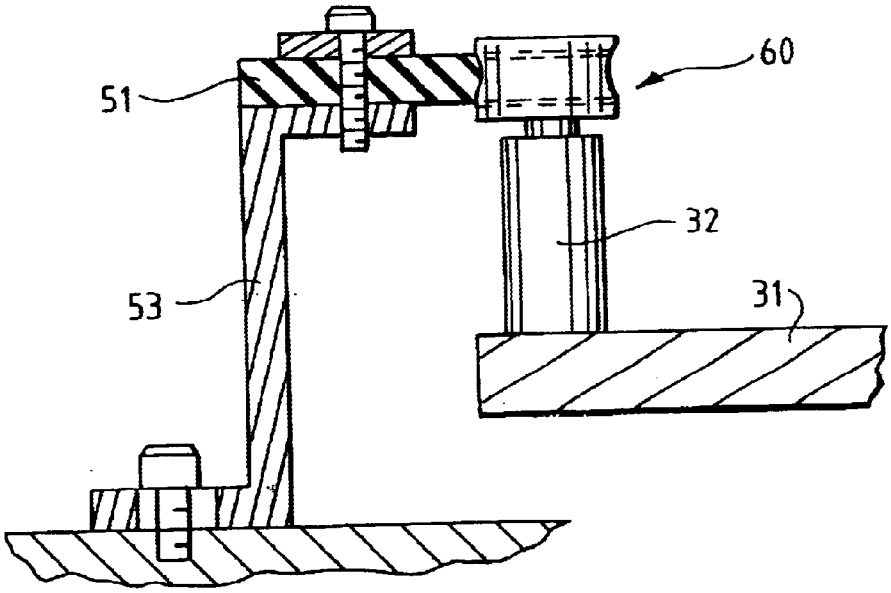
FIG. 9 is a cross-sectional view taken along line 9—9 of FIG. 2.
Figure 10:
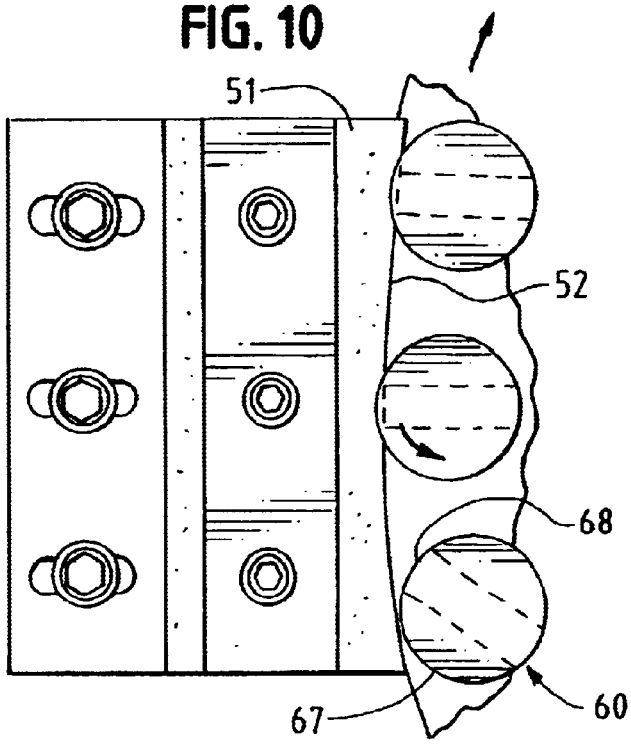
FIG. 10 is a plan view showing the operation of one preferred guide member arrangement.
Figure 11:
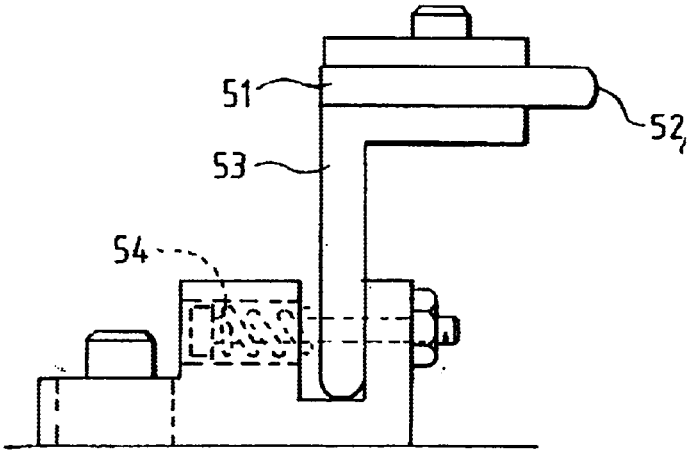
FIGS. 11 and 12 are, respectively, side and plan views of another preferred guide member arrangement.
Figure 12:
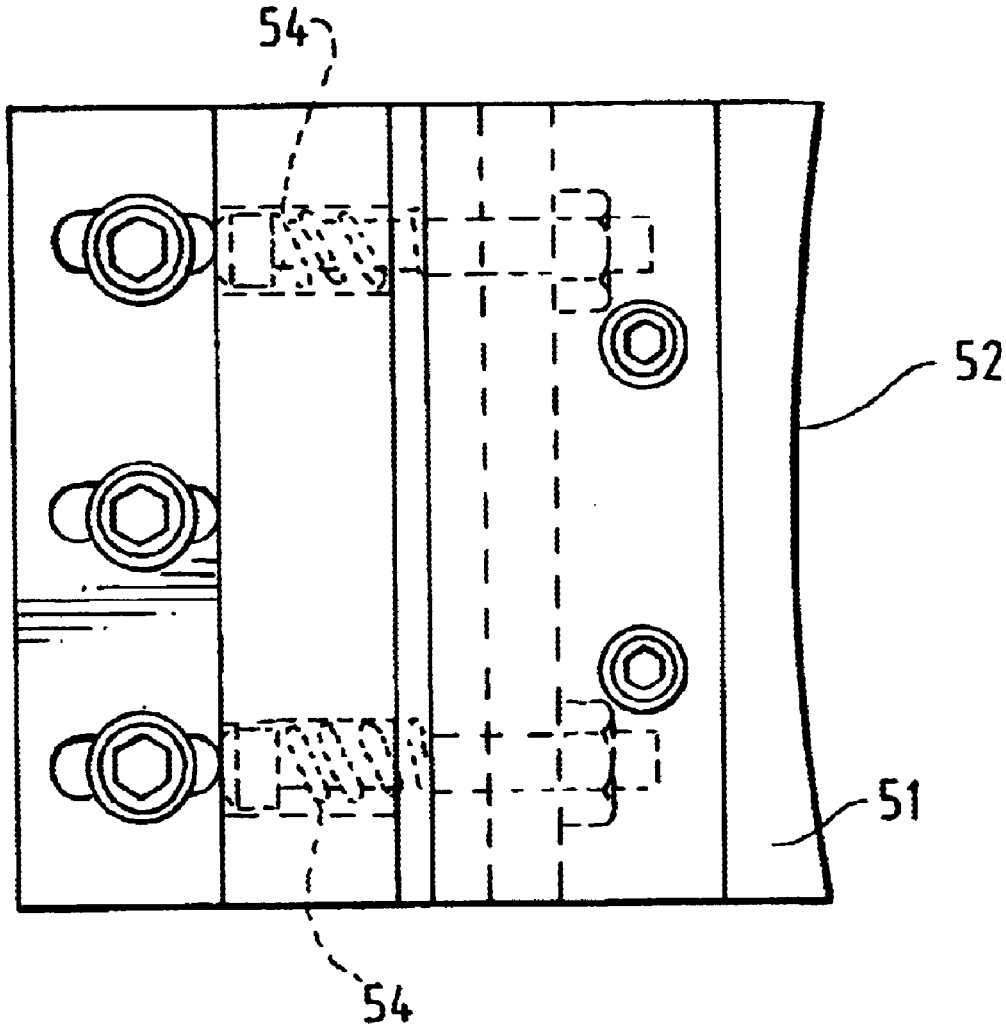

The guide member 51 is preferably fabricated from an elastomeric material and includes a guide surface 52 shaped to conform to the path of travel of the fasteners 60. For example, when the conveyor 30 moves the fasteners along a circular path, as illustrated, then the guide surface 52 may preferably define an arc whose radius generally conforms to that circular path. The guide member 51 is secured in a guide support 53 which may be fixedly mounted, as illustrated in FIG. 9. Alternatively, the guide support 53 may be movably mounted and biased toward the conveyor (and fasteners) by use of a compression spring 54, as illustrated in FIGS. 11 and 12. In either arrangement, the guide member 51 is positioned so that surface 52 engages the circumference 67 of each fastener 60 to rotate the fastener until the interruption 68 is juxtaposed or face to face with surface 52. At this point, the fasteners 60 will remain rotationally stationary for the remainder of their path of travel through the orientation station 50 and until they exit the application station 40. In this rotationally stationary orientation the threaded bore 66 of each fastener extends radially, relative to the circular conveyor table 31, and will intersect the resin stream in the application station 40. In this manner, a suitable resin patch may be applied to the internal threads to achieve the desired self-locking function.

While the invention has been described with reference to the preferred embodiments thereof, it will be appreciated that numerous variations, modifications, and alternate embodiments are possible including the use of the apparatus with objects other than fasteners. Accordingly, all such variations, modifications, and alternate embodiments are to be regarded as being within the spirit and scope of the invention.

We claim:

1. An apparatus for the application of a polymer resin to threaded fasteners, each of said fasteners including a cylindrical body having a threaded bore wherein the bore is oriented perpendicular to the longitudinal axis of the cylindrical body and defines an interruption in the circumference of the cylindrical body, said apparatus comprising:

a conveyor for moving the threaded fasteners;

at least one support member for carrying one or more of said fasteners on said conveyor, the fasteners being rotatable relative to said conveyor;

a resin application station positioned adjacent said conveyor, including a resin spray nozzle arrange to direct a stream of resin toward the moving fasteners; and an orientation station positioned adjacent said conveyor, including a guide member arranged to engage each of said fasteners as they move along said path of travel to rotate the fasteners about the axis of their cylindrical body such that the threaded bore of the fasteners is placed into a position to intersect the resin stream as the fasteners pass the resin application station;

said support member adapted to hold the fasteners rotationally stationary as the fasteners pass the resin application station.

2. The apparatus of claim 1 wherein the bore in the fastener defines an interruption in the circumference of the fastener cylindrical body and the guide member engages said circumference as the fastener moves toward said resin application station, said fastener being thereby rotated to a position wherein the circumference interruption faces the guide member.

3. The apparatus of claim 1 wherein said guide member has a curved surface which engages the cylindrical body of each of the fasteners to rotate the fasteners.

4. The apparatus of claim 3 wherein said guide member is resiliently biased toward the path of travel of said fasteners.

5. The apparatus of claim 1 wherein each of said fasteners move along a circular path of travel and the guide member includes an arcuate resilient surface arranged to engage the cylindrical body of said fasteners.

6. The apparatus of claim 1 wherein the resin spray nozzle is vertically and horizontally adjustable.

7. The apparatus of claim 1 wherein the orientation station is vertically and horizontally adjustable.

8. The apparatus of claim 5 wherein the arcuate resilient surface of the guide member is positioned to engage the circumference of the fastener cylindrical body to rotate the fasteners except when the interruption on the cylindrical body is juxtaposed with the arcuate resilient surface at which point the fasteners remain rotationally stationary with the bore of the fasteners placed into a position to intersect the resin stream as the fasteners pass the application station.

9. An apparatus for the application of a polymer resin to threaded fasteners, each of said fasteners including a cylindrical body having a threaded bore wherein the bore is oriented perpendicular to the longitudinal axis of the cylindrical body and defines an interruption in the circumference of the cylindrical body, said apparatus comprising:

a conveyor for moving the threaded fasteners;

at least one support member for carrying one or more of said fasteners on said conveyor, the fasteners being rotatable relative to said conveyor;

a resin application station positioned adjacent said conveyor, including a resin spray nozzle arranged to direct a stream of resin toward the moving fasteners and into the threaded bore of the fasteners; and an orientation station positioned adjacent said conveyor, including a guide member having a surface arranged to engage the circumference of the cylindrical body of the fasteners to rotate the fasteners except when the interruption is juxtaposed with said surface at which point the fasteners remain rotationally stationary with the threaded bore of the fasteners placed in a position to intersect the resin stream as the fasteners pass the resin application station.

10. The apparatus of claim 9 wherein said surface of said guide member is curved.

11. An apparatus for the application of a polymer resin to threaded fasteners, each of said fasteners including a cylindrical body having a threaded bore wherein the bore is oriented perpendicular to the longitudinal axis of the cylindrical body and defines an interruption in the circumference of the cylindrical body, said apparatus comprising:

a conveyor for moving the threaded fasteners;

at least one support member for carrying one or more of said fasteners on said conveyor, the fastener being rotatable relative to said conveyor;

a resin application station positioned adjacent said conveyor, including a resin spray nozzle arranged to direct a stream of resin toward the moving fasteners and into the threaded bore of the fasteners; and a guide means for engaging the circumference of the cylindrical body of the fasteners to rotate the fasteners except when the interruption is juxtaposed with the guide means at which point the fasteners remain rotationally stationary with the threaded bore disposed in a position to intersect the resin stream as the fasteners pass the resin application station.

12. An apparatus for the application of a polymer resin to threaded fasteners, each of said fasteners including a cylindrical body having a threaded bore wherein the bore is oriented perpendicular to the longitudinal axis of the cylindrical body and defines an interruption in the circumference of the cylindrical body, said apparatus comprising:

a conveyor for moving the threaded fasteners;

at least one support member for carrying one or more of said fasteners on said conveyor, the fasteners being rotatable relative to said conveyor;

a resin application station positioned adjacent said conveyor, including a resin spray nozzle arranged to direct a stream of resin toward the moving fasteners and into the threaded bore of the fasteners; and an orientation station positioned adjacent said conveyor, including a guide member having a curved surface arranged to engage the circumference of the cylindrical body of the fasteners to rotate the fasteners except when the interruption is juxtaposed with said curved surface at which point the fasteners remain rotationally stationary with the threaded bore of the fasteners placed in a position to intersect the resin stream as the fasteners pass the resin application station.

* * * * *